US008387163B2

(12) United States Patent
Beliveau

(10) Patent No.: US 8,387,163 B2
(45) Date of Patent: Mar. 5, 2013

(54) FLEXIBLE FACE MASK APPARATUS

(76) Inventor: Robert Gregory Beliveau, San Pedro, CA (US)

( * ) Notice: Subject to any disclaimer, the term of this patent is extended or adjusted under 35 U.S.C. 154(b) by 133 days.

(21) Appl. No.: 12/798,197

(22) Filed: Mar. 31, 2010

(65) Prior Publication Data

US 2011/0239347 A1 Oct. 6, 2011

(51) Int. Cl.
*A41D 13/00* (2006.01)
*A42B 1/00* (2006.01)

(52) U.S. Cl. ..... 2/9; 2/13; 2/206; 128/857

(58) Field of Classification Search ..... 2/206, 173, 2/174, 9, 11, 12, 15, 422, 423, 424, 425, 2/410, 13, 448, 450, 429, 207, 202, 427; 128/857, 858, 97.1, 206.12, 206.13, 863, 128/864, 866, 859, 206.28, 206.19, 207.11; 351/47

See application file for complete search history.

(56) References Cited

U.S. PATENT DOCUMENTS

| | | | | | |
|---|---|---|---|---|---|
| 167,543 | A | * | 9/1875 | Kleinert | 2/206 |
| 309,491 | A | * | 12/1884 | Price | 2/206 |
| 351,248 | A | * | 10/1886 | Britton | 2/206 |
| 364,733 | A | * | 6/1887 | Sentman | 2/206 |
| 535,718 | A | * | 3/1895 | Nagler | 128/206.12 |
| 766,963 | A | * | 8/1904 | Murray | 2/91 |
| 925,409 | A | * | 6/1909 | Woolf et al. | 128/206.16 |
| 1,179,473 | A | * | 4/1916 | Taylor | 2/172 |
| 1,218,352 | A | * | 3/1917 | Arbogast et al. | 2/206 |
| 1,279,884 | A | * | 9/1918 | La Roche | 2/206 |
| 1,286,326 | A | * | 12/1918 | Howard | 2/15 |
| 1,291,846 | A | * | 1/1919 | Greenfield | 2/206 |
| 2,159,435 | A | * | 5/1939 | Gribbin | 2/174 |
| 2,243,982 | A | * | 6/1941 | Seeley | 2/12 |
| 2,364,354 | A | * | 12/1944 | Felch | 2/206 |
| 2,541,242 | A | * | 2/1951 | Grove | 2/13 |
| 2,667,869 | A | * | 2/1954 | Elia | 128/857 |
| 2,669,717 | A | * | 2/1954 | Diggs | 2/9 |
| 2,677,133 | A | * | 5/1954 | Hoffman, Jr. | 2/206 |
| 2,728,339 | A | * | 12/1955 | Elmhirst | 606/204.15 |
| 2,882,892 | A | * | 4/1959 | Kosior | 606/204.15 |
| 3,298,031 | A | * | 1/1967 | Morgan | 2/9 |
| 3,310,812 | A | * | 3/1967 | Gaisser | 2/9 |
| 3,346,875 | A | * | 10/1967 | Weisberger | 2/9 |
| 3,823,418 | A | * | 7/1974 | Piper | 2/206 |
| 4,084,585 | A | * | 4/1978 | Venaleck | 128/206.13 |
| D274,385 | S | * | 6/1984 | Newcomb | D29/108 |
| 4,641,379 | A | * | 2/1987 | Martin | 2/9 |

(Continued)

FOREIGN PATENT DOCUMENTS

WO WO2009131404 * 10/2009

*Primary Examiner* — Khoa Huynh
*Assistant Examiner* — Brieanna Fuller

(57) ABSTRACT

A flexible face mask is provided for protecting the face from outdoor elements. The face mask comprises a nose shield portion configured to cover the user's nose, a pair of cheek shield portions configured to cover the sides of the user's face, and a pair of ear strap portions configured to cover and receive the user's ears and eyewear. A reinforcing strip on the skin-facing side of the nose shield allows the nose shield to better conform to the user's nose. The face mask is configured for attachment to both eye glasses and goggles. For eyeglasses, a pair of small "C" - shaped cuts in the nose shield are configured to receive the nose pads of the eyeglasses. For goggles or eyeglasses, a set of hook and loop patches are utilized, wherein one patch is affixed to the eyewear's bridge and the mating patch is affixed to the nose shield.

8 Claims, 16 Drawing Sheets

U.S. PATENT DOCUMENTS

| | | | | | |
|---|---|---|---|---|---|
| 4,671,271 | A | * | 6/1987 | Bishop et al. | 128/206.11 |
| 4,821,340 | A | * | 4/1989 | Johnson | 2/9 |
| 4,908,878 | A | * | 3/1990 | Tarragano | 2/15 |
| 5,206,956 | A | * | 5/1993 | Olson | 2/13 |
| D355,715 | S | * | 2/1995 | Hubbard et al. | D24/110.2 |
| 5,388,269 | A | * | 2/1995 | Griffin | 2/13 |
| 5,416,923 | A | * | 5/1995 | Peugh | 2/9 |
| D380,545 | S | * | 7/1997 | Nozaki et al. | D24/110.1 |
| 5,666,664 | A | * | 9/1997 | Hamilton | 2/13 |
| 5,704,063 | A | * | 1/1998 | Tilden | 2/9 |
| 5,928,262 | A | * | 7/1999 | Harber | 606/204.35 |
| 5,928,264 | A | * | 7/1999 | Sugarbaker et al. | 606/207 |
| 7,228,858 | B2 | * | 6/2007 | Baker | 128/201.22 |
| 7,272,861 | B2 | * | 9/2007 | Colletti et al. | 2/206 |
| D594,895 | S | * | 6/2009 | Ross et al. | D16/309 |
| 2003/0015205 | A1 | * | 1/2003 | Lai | 128/857 |
| 2004/0078860 | A1 | * | 4/2004 | Bell et al. | 2/9 |
| 2009/0241242 | A1 | * | 10/2009 | Beatty et al. | 2/206 |

* cited by examiner

A

B

A

B

A

B

A

B

A

B

A

B

A

B

A

B

A

B

A

B

FLEXIBLE FACE MASK APPARATUS

BACKGROUND OF THE INVENTION

1. Field of the Invention

This invention pertains to recreational face masks designed to protect the face and nose from sunburn and frostbite.

2. Background Information

Today's society is increasingly involved in outdoor sports and recreational activities yet concerns about avoiding skin cancer and other harmful effects of the sun are also greater than ever. In particular, there is a need among outdoor enthusiasts (e.g. mountaineers, cyclists, skiers) to protect their nose and face from exposure to harmful Ultraviolet light and extreme cold, wind, and particulate matter that may cause frostbite or discomfort. Importantly, there is a need for face masks that are versatile and can be easily attached to various types of eyewear, such as eyeglasses and goggles. Some masks are made of non-breathable, plastic material which causes the skin to sweat and causing condensation to reach the user's eyewear, fog the lenses, and obstruct vision. Flexibility and comfort are often sacrificed for durability, and vice versa. Other masks on the market do not comfortably attach or conform to the face, such as those that utilize a plastic clip-on mechanism to attach to the user's eyeglasses. Other masks have utilized a relatively thick (e.g. 2-inch) strap that wraps around the user's head and attaches using a hook and loop (i.e. VELCRO®) mechanism. These clip-on mechanisms are often irritating and the masks feature nose covers that are not sufficiently flexible and do not properly conform to the nose. Because prior art face masks do not offer sufficient flexibility and often come in only one size, it is difficult for the user to achieve a good fit. Moreover, due to their rigid structure and poor fit, existing face masks seriously hinder eating and talking. Existing face masks either lack comfort, cannot be used with various eyewear, do not adequately conform to a user's nose and face, are not breathable, cause excess perspiration and eyewear fogging, are not suitable for physical outdoor activity, and/or do not offer sufficient protection from the elements.

U.S. Pat. No. 3,346,875 to Weisberger (1967) discloses a nose and lip cover which detachably connects to each other and to a pair of eyeglasses. However, such a device is limited for use with eyeglasses and does not provide a comfortable fit or attractive appearance. U.S. Pat. No. 5,167,036 to Daprato (1992) discloses a nose protector configured to attach to eyeglasses, but consists of a shield and a complex system of cords for attaching the protective nose cover to the eyeglasses. Again, this device can only be used with eyeglasses and does not have an easy means of attachment. Similarly, the sun-protective nose cover disclosed in U.S. Pat. No. 5,717,992 to Tilghman (1998) can only be attached to eyeglasses via a loop strap, and does not provide a conforming fit due to a lack of flexibility.

Breathability is also an important factor for reducing sweat and providing comfort, and minimizing the fogging of eyewear. U.S. Pat. No. 5,274,847 to Lauttamus (1994) discloses a sun-protective nose cover that attaches to eyeglasses or goggles using a strap that is looped over the bridge of the eyewear. However, the Lauttamus nose cover is described as being of tear-able and crease-able material, which limits the device to non-breathable materials such as paper or plastic. Other more fashion-oriented garments exist to cover the head and face, such as that disclosed in U.S. Pat. No. 5,845,340 to Frislie (1998). Frislie discloses a face and head garment that fully covers the head and face of the user with eye, nose, and mouth openings. However, this garment is uncomfortable and does not allow the user to communicate, and is more akin to a costume mask. U.S. Pat. No. 4,095,290 to O'Brien (1978) discloses a face mask made of a three-part lamination process that includes a thermal barrier. However, this mask covers the entire face of the user and is only designed for cold weather use. Moreover, the nose opening of this mask is a flap that does not adequately protect the nose from frostbite. U.S. Pat. No. 6,374,424 to Tredup (2000) claims a protective face mask made of hard plastic to block the sun's harmful rays wherein the entire mask is a hard plastic or UV lens material. Such a device is relatively heavy, and nevertheless not flexible, resulting in an uncomfortable and non-deal fit. U.S. Pat. No. 5,634,210 to King, et al. (1997) discloses a cardboard face shield for protection against the sun. Although such a device may be lightweight and provide adequate sun protection, it is essentially a disposable one-time use item. Furthermore, it does not attach to eyewear, and it is not breathable or comfortable because it rigidly covers the entire face.

U.S. Pat. No. 7,000,252 to Tobin (2006) discloses a face mask formed of an impact-resistant sheet to contour of a face, with a series of resilient pads mounted on the inner surface of the mask adjacent to forehead and cheek areas. This device, however, falls into the category of protective sports equipment, and is only designed for avoiding injury due to physical impact. U.S. Pat. No. 7,290,545 to Kleman, et al. (2007) discloses a facemask that purportedly reduces or eliminates fogging of the eyewear worn by the user of the face mask. However, this device is a medical mask intended for medical purposes. In summary, existing sun-protective face masks suffer from one or more of the following disadvantages:

- Lack of versatility with respect to uses (e.g. not suitable for outdoor and athletic activities);
- Lack of versatility with respect to attachment or interface with various types of eyewear;
- Lack of sun or UV protection;
- Lack of flexibility and conformity fit to the face;
- Lack of breathability, causing sweating and eyewear fogging; and
- Lack of comfort with respect to the size, weight, or means of attachment to the face.

Thus, there is a need in the market for a sun-protective, breathable face mask that attaches to various types of eyewear and is durable but comfortably conforms to the face for physical, outdoor activities. The face mask disclosed herein addresses these needs.

SUMMARY

In accordance with the present invention, a flexible face mask is provided for protecting the face from sunlight, wind, and other outdoor elements. Various embodiments of the face mask provide varying levels of facial coverage to suit user preferences. In a first embodiment, the face mask comprises a nose shield portion configured to cover and conform to the user's nose, a lip shield portion configured to cover the user's upper lip, a pair of cheek shield portions configured to cover the sides of the user's face, and a pair of ear strap portions configured to cover the ears, and receive the user's ears and eyewear via a pair of "C"-shaped cuts and curved insertion slits, respectively. A reinforcing strip on the skin-facing side of the nose shield provides structure and allows the nose shield to better conform to the user's nose. The face mask features two means of attachment to various forms of eyewear. For eyeglasses, a pair of small "C"-shaped cuts in the upper center portion of the nose shield are configured to receive the nose pads of the user's eyeglasses to further secure the face mask to the user's face. For goggles, a set of hook and loop (i.e. VELCRO®) patches with adhesive backings can be utilized, wherein one patch is affixed to the underside of the eyewear's nose bridge and the mating patch is affixed to the area inside the "C" cuts of the nose shield. A second embodiment of the face mask provides less facial coverage and only covers the nose, cheek bones, and ears. A third embodiment of the face mask provides more facial coverage and covers the nose, cheeks, ears, upper and lower lips, and chin. In a preferred embodiment, the face mask is composed of an outer first layer of spandex having a sun protective factor, an intermediate second layer of open-cell foam, and a third layer of micro-suede material that contacts the skin.

BRIEF DESCRIPTION OF THE DRAWINGS

The present invention, in accordance with preferred and exemplary embodiments, together with further objects and advantages thereof, is more particularly described in the following detailed description taken in conjunction with the accompanying drawings in which:

FIGS. 8A-B show the low-coverage face mask with a hook patch affixed for securing the nose shield to the user's goggles.

DETAILED DESCRIPTION

In a preferred embodiment, the face mask of the present invention is constructed of three flexible, light, and durable layers: an outer first layer of fabric having a sun protective factor, an intermediate second layer of open cell foam material, and a third layer of micro suede or brushed nylon material that contacts the face. The outer first layer is such that it can be embossed, debossed, or sublimated with a desired image or print logo/design. The outer layer may be composed of spandex (e.g. polyurethane-polyurea copolymer). The intermediate layer can be breathable foam such as open-cell foam or perforated closed-cell foam (e.g. airprene). The foam layer may be about 0.25 inches thick prior to being compressed into a far thinner desired thickness. The third layer of micro-suede has a breathable, wicking effect that allows greater air exchange and acts against the discomfort and eyewear fogging caused by moisture buildup. The layers can be joined via a thermoforming process and preferably cut via laser cutting or comparable method to provide well-sealed edges that are resistant to de-lamination. The resulting mask material can be repeatedly used and washed. For example, the micro-suede layer can first be flame-bonded to the spandex layer, with the foam layer sandwiched in between, followed by thermoforming. The result is a light, flexible, durable and more breathable mask that is superior to those existing in the market (e.g. plastic, neoprene).

Although, certain materials and manufacturing processes are disclosed herein, other comparable or suitable methods may be employed, as known in the art, to carry out the invention. It should also be understood that the face masks disclosed herein can be made in different sizes to suit various users, and the dimensions of mask features can be modified while keeping with the spirit of the invention. Three embodiments of the face mask of the present invention are described below, each providing varying degrees of face coverage: low-coverage face mask, medium-coverage face mask, and full-coverage face mask. Other than the difference in coverage levels, the three mask embodiments are the same.

Figure 1:
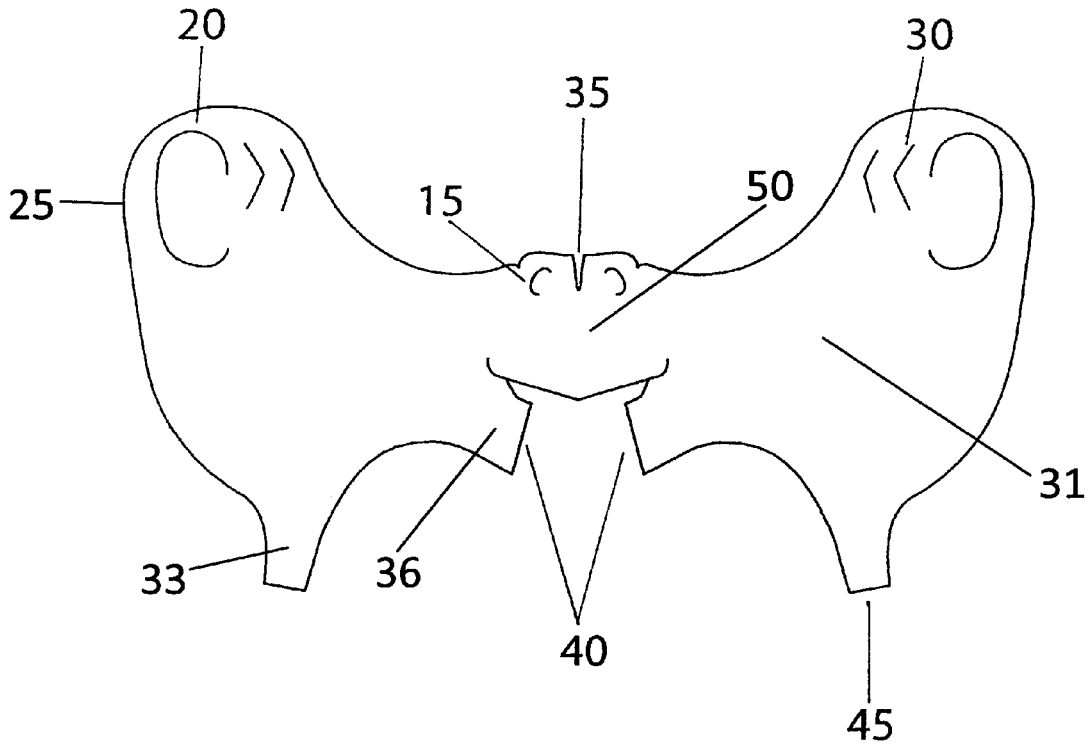
FIG. 1 shows a flat cut view of a low-coverage face mask in accordance with the present invention.
Figure 16:
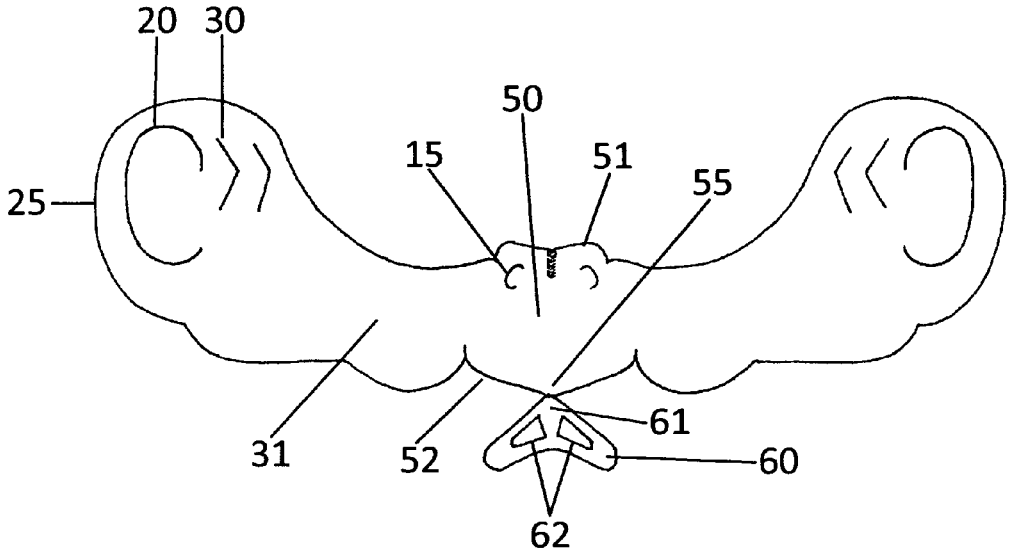
FIG. 16A-B shows an alternate embodiment of the face mask with an extended nose shield that covers the nostril openings.
Figure 16:
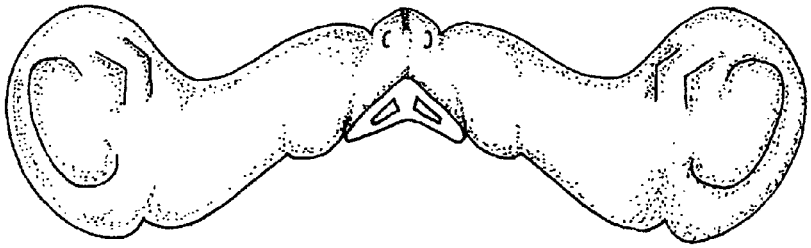

FIG. 1 shows a flat, front view of an exemplary embodiment of the present invention, a medium-coverage face mask with exposed lower lip and chin in accordance with the present invention. For ease of reference, the face mask will also be referred to as a "mask" herein. The face mask contains three seams to be sewn: upper seam 35, mid seam 40, and lower seam 45. In this unassembled, flat view, the face mask has a butterfly-like shape. In the top center portion of the mask (top of the nose shield 50) is upper seam 35 which rests on the bridge of the nose. In the bottom center portion of the mask is mid seam 40, which allows the tip of the nose and nostrils to be exposed for breathing. In the lower left and right corners of the mask is lower seam 45 that attaches below the chin to act as a chin/jaw strap. 33 Seams 35, 40, and 45 are then sewn together to form the wearable mask. Front and side views of the assembled medium-coverage mask are shown in FIGS. 5A-B and 12A-B. The medium-coverage mask covers the user's nose, upper lip, cheeks, and ears—while leaving the lower lip and chin exposed. The portion of the face mask that covers the nose will be referred to as the "nose shield" 50. Similarly, the portion of the mask that covers the user's upper lip will be referred to as the "lip shield" 36. Furthermore, the portion of the mask that covers the user's cheeks or sides of the face will be referred to as "cheek shields" 31. The lip shield protects the user's upper lip and mouth from the sun and wind. The lip shield is also designed to direct the user's breath away from the mask so that it dos not enter the mask and cause moisture buildup and/or fogging of the user's breath. Thus, the user is able to breath through the nostrils and the mouth. In an alternate embodiment, the nose shield 50 is extended such that it covers the nostrils but allows breathing and ventilation through nostril holes as shown in FIG. 16A-B.

The mask body may also have a plurality of small perforations or holes that allows air to flow in and out of the mask.

Figure 14:
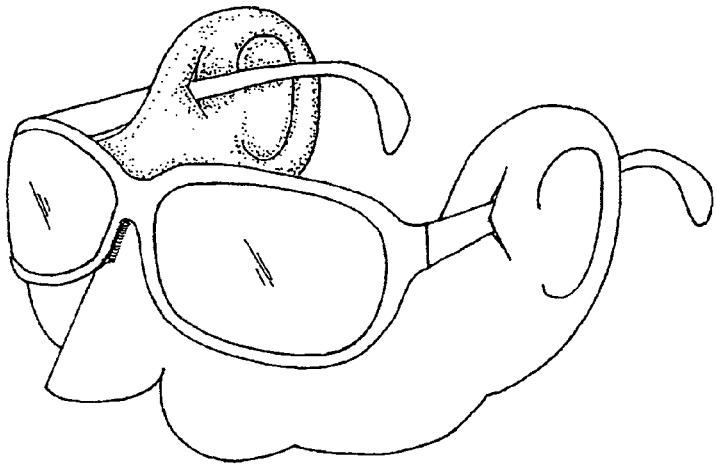
FIGS. 14A-B show a low-coverage face mask attached to a pair of eyeglasses via the small "C"-shaped cuts and insertion slits in accordance with the present invention.
Figure 14:
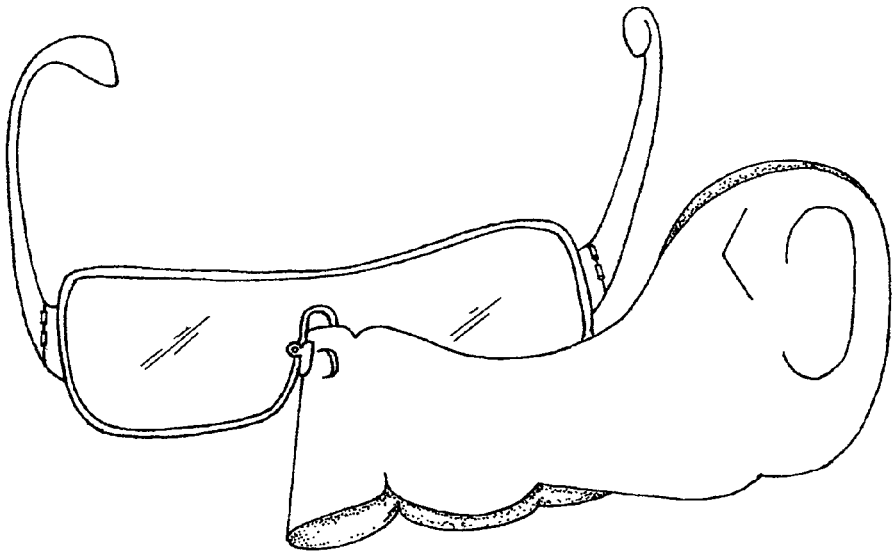
Figure 15:
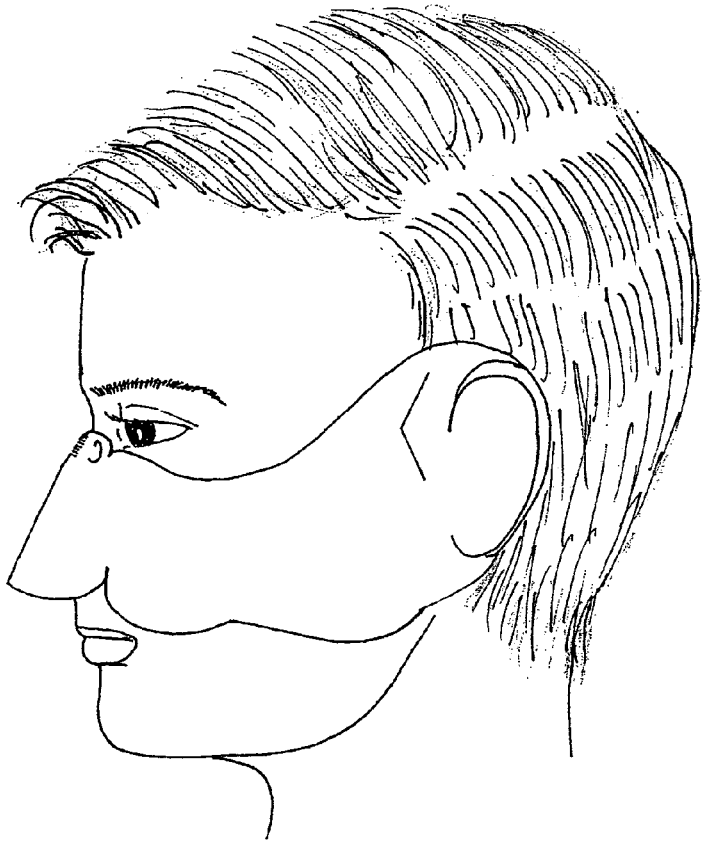
FIG. 15 shows the low-coverage mask worn on a user's face.

The face mask further comprises curved insertion slits 30, which are through-cuts on left and right ear strap portions 25 of the mask configured to receive the temples of eyeglasses and thus secure the face mask to the user's eyeglasses (as used herein, the term "eyeglasses" includes sunglasses) as shown in FIG. 14A. Normally, a user's eyeglasses would slide or fall off the user's face when the user is in certain positions (e.g. looking downward) or during turbulent activities (e.g. mountain biking, skiing). However, when passed through curved insertion slits 30, the eyeglasses are securely held in place. To the outside of the curved insertion slits 30 are ear "C" cuts 20 which are configured to receive the user's ears. When putting on the face mask, the user stretches the ear straps 25 of the mask until the ear "C" cuts can be put around the ears, eliminating the slack in the mask and providing a snug fit as shown in FIG. 15 (featuring the low-coverage mask). As shown in FIG. 1, the portion of material to the outside of ear "C" cuts is relatively thin and thus more easily stretched than other portions of the mask. In an alternate embodiment, this portion can be made of a softer and more elastic material than the rest of the mask. This can provide for greater user comfort with respect to the attachment of the mask around of the ears and also allows the mask to adjust better to different ear and head sizes.

Figure 7:
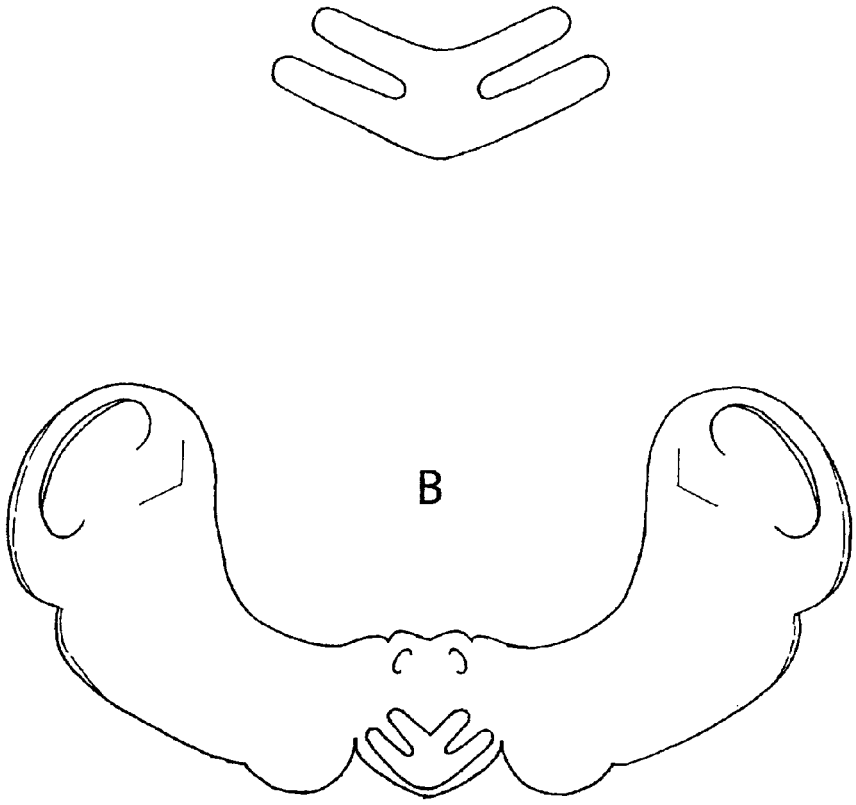
FIGS. 7A and 7B show a reinforcing strip that is affixed behind the nose shield portion of a low-coverage face mask in accordance with the present invention.
Figure 8:
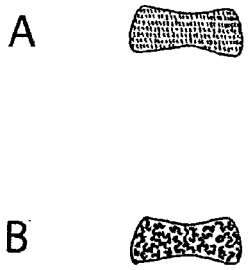
FIGS. 8A and 8B are front views of hook and loop (i.e. Velcro) patches, respectively, in accordance with the present invention.
Figure 9:
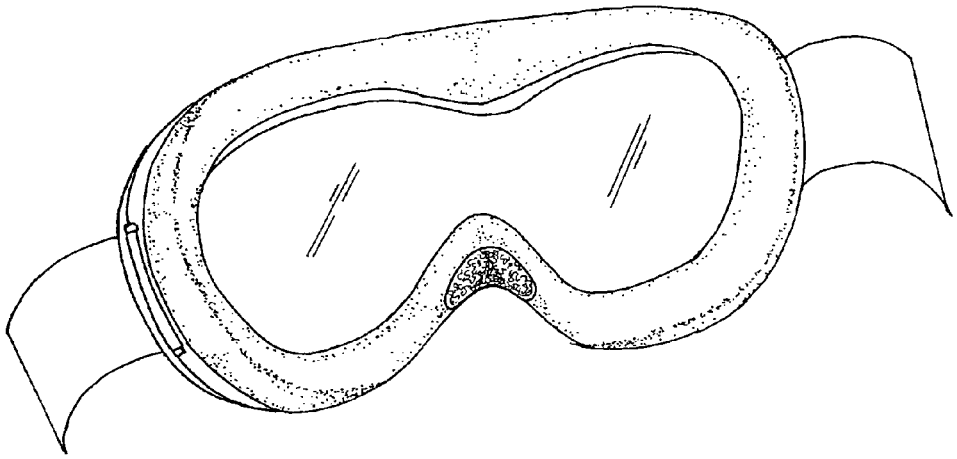
FIGS. 9A-B are inside views of eye goggles and eyeglasses, respectively, with a loop patch affixed to under the bridge of the eyewear in accordance with the present invention.
Figure 9:
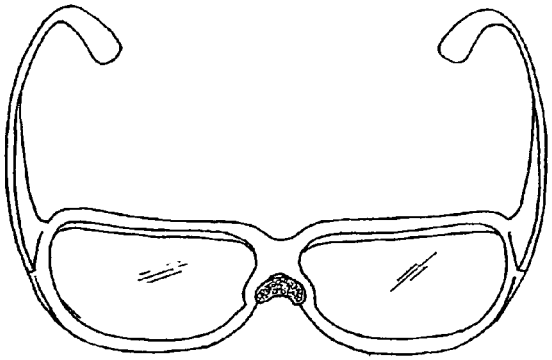
Figure 10:
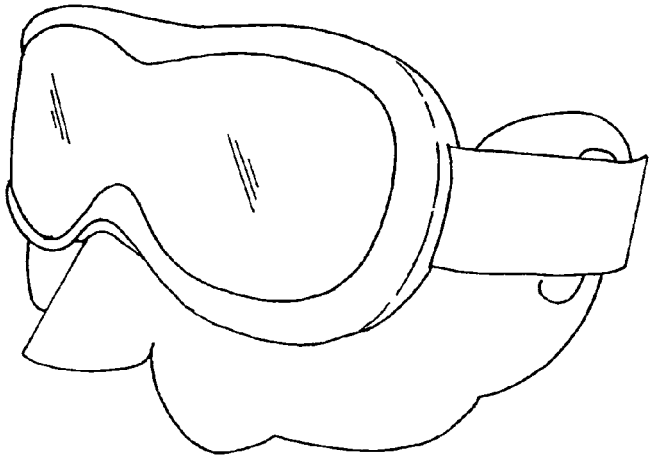
FIGS. 10A-B show the eye goggles and eyeglasses of FIGS. 9A-B attaching to a low coverage face mask having a corresponding hook patch.
Figure 10:
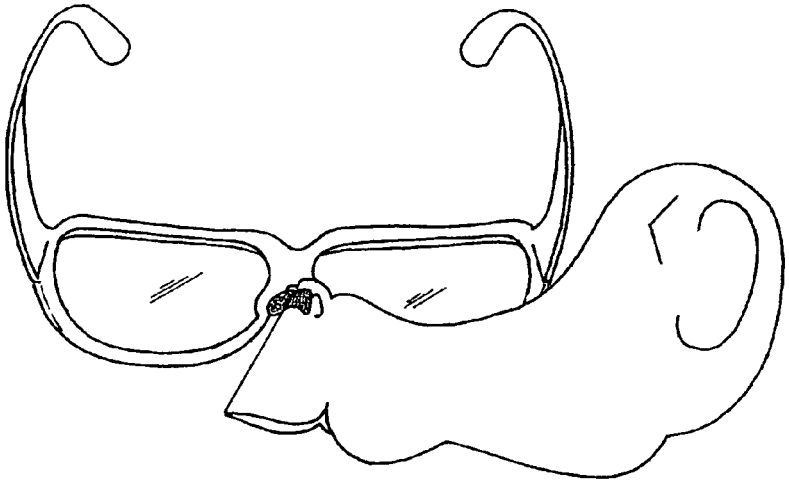
Figure 11:
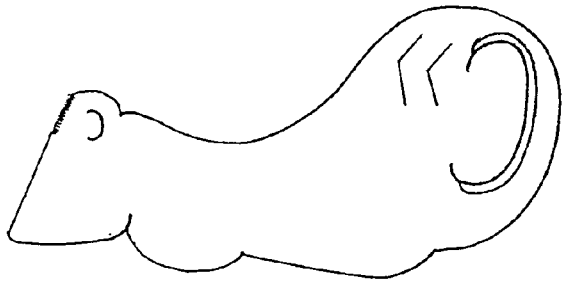
FIGS. 11A-B are side and perspective views of the low-coverage face mask.
Figure 11:
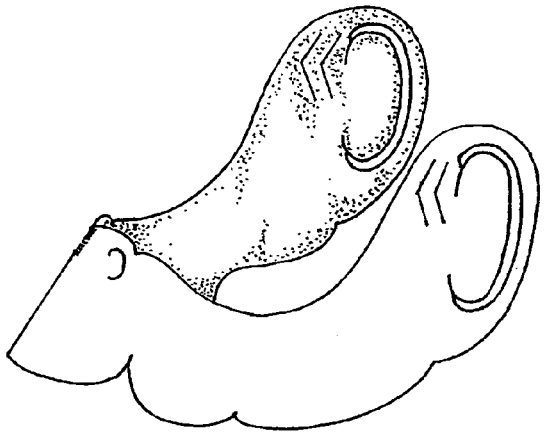
Figure 12:
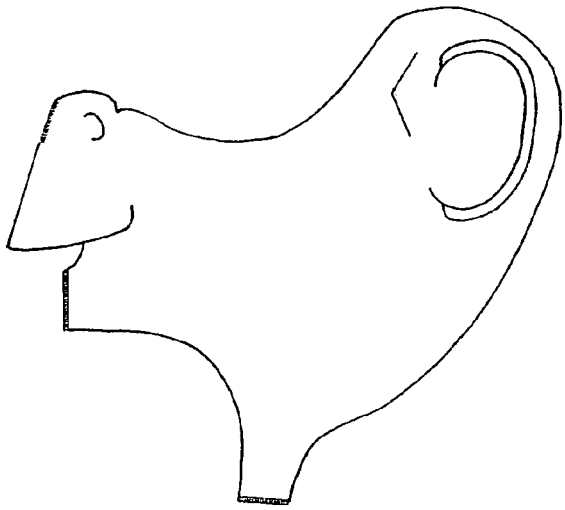
FIGS. 12A-B are side and perspective views of the medium-coverage face mask.
Figure 12:
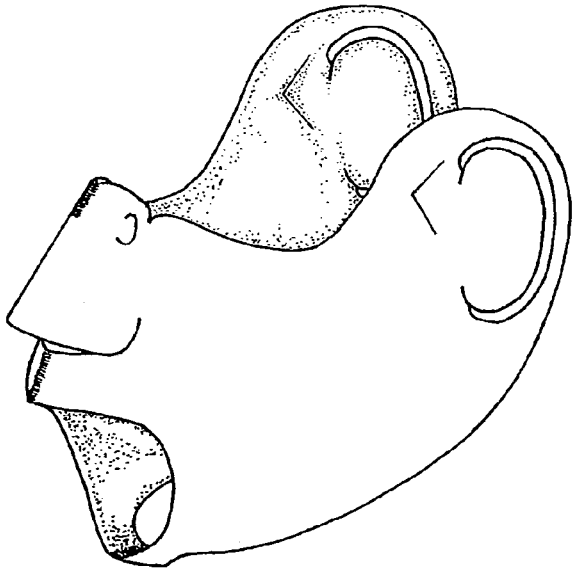
Figure 13:
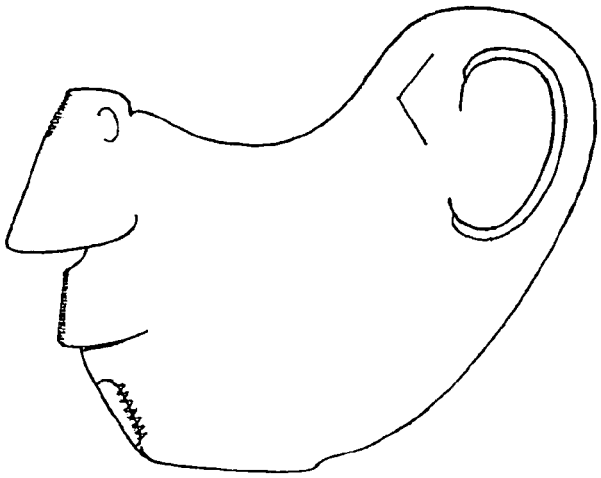
FIGS. 13A-B are side and perspective views of the full-coverage face mask.
Figure 13:
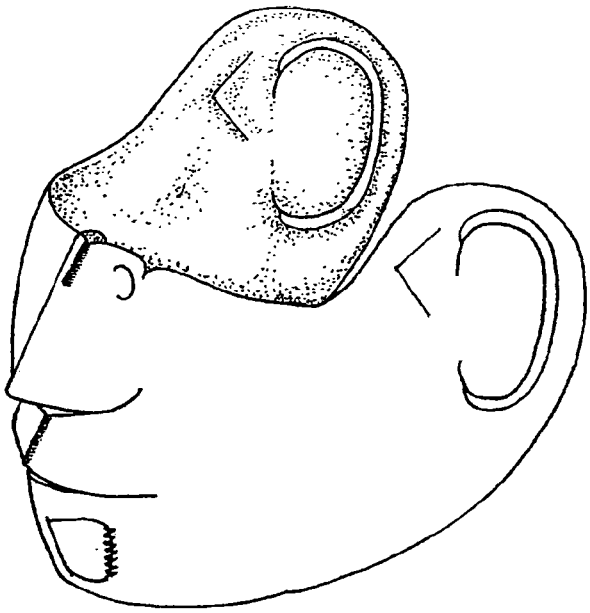

To further secure the face mask to the user's face, two alternative mechanisms allow the user to optionally secure the nose shield 50 to their eyewear. When wearing eyeglasses with nose pads, the user can insert the nose pads through the nose "C" cuts 15 (as shown in FIG. 14B). If wearing ski-type goggles, the user can utilize two hook and loop (i.e. VELCRO®) patches as shown in FIGS. 9A and 10A, each having an adhesive backing wherein one patch is affixed to the underside of the eyewear's nose bridge (as shown in FIGS. 9A-B), and the mating patch is affixed to the area inside the "C" cuts 15 (as shown in FIG. 10B) in the upper center of the nose shield portion 50. The resulting combination of mask and goggle is shown in FIG. 8B. Either of these two methods secures the nose shield portion 50 of the mask to the user's eyewear for a more secure fit. In a preferred embodiment, a thin reinforcing strip (shown in FIG. 7A) is affixed to the third layer (skin-facing side) of the nose shield portion 50 of the face mask as shown in FIG. 7B. The reinforcing strip is made of a flexible material that can be bent or creased to keep the nose shield portion 50 of the mask contoured to the shape of the user's nose. While the reinforcing strip can take various shapes, it should run laterally (horizontally) from one side the nose shield to the other in order to provide structural support to the nose shield (and allow the nose shield to be contoured to the nose. The reinforcing strip is preferably a polymeric film such as polyester. Examples of suitable polyester films known in the art include MYLAR® (polyethylene terephthalate) and DURA-LAR®. Alternatively, the reinforcing strip can be made of a thin strip of metal (e.g. aluminum). The reinforcing strip should be thin enough to be flexible and have a low profile, but thick enough to provide some structure to the nose shield. For example, the thickness of the reinforcing strip can be approximately 0.005 inches.

Figure 2:
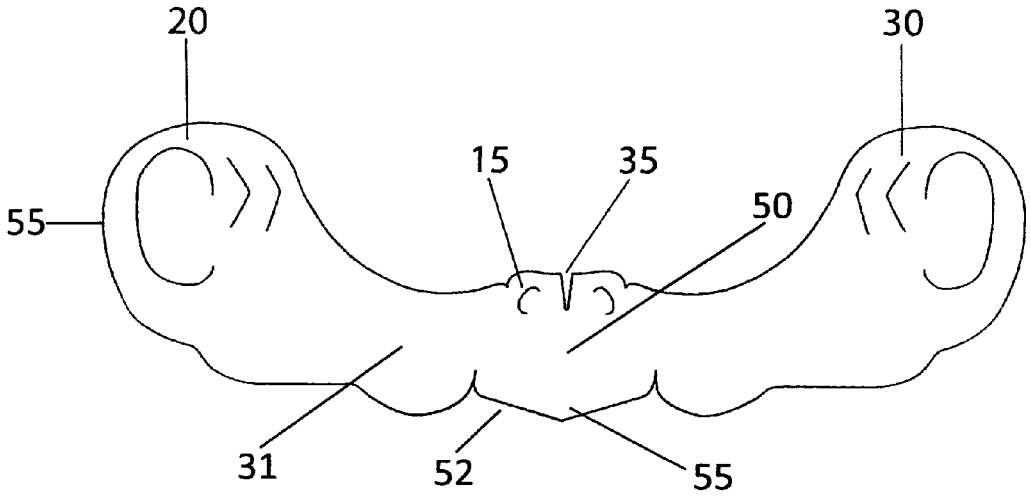
FIG. 2 shows a flat cut view of a medium-coverage face mask in accordance with the present invention.

FIG. 2 shows an alternate embodiment of the present invention, a low-coverage face mask that provides less face coverage than the face mask of FIG. 1. The low-coverage mask has the same features as the medium-coverage mask in FIG. 1 except it lacks the mid seam 40 and lower seam 45 because it does not cover the upper lip or strap under the chin. The low-coverage has only two seam lines, upper seam 35 and mid-seam 40. The semi-mask covers the user's ears, upper cheeks, and nose, leaving the mouth and chin exposed, which may be preferable by certain users or under certain conditions that favor less face coverage. As with the medium-coverage mask of FIG. 1, the low-coverage includes curved insertion slits 30 on left and right sides of the mask, as well as left and right ear "C" cuts located just outside the curved insertion slits 30. To the outside of the curved insertion slits 30 are ear "C" cuts 20 which are configured to receive the user's ears and secure the mask to the face as described above. The face mask can be further secured by attaching to the user's eyewear via the "C" cuts 15 or with hook and loop patches, as set forth in the description of FIG. 1. Further, the face mask may include an extended nostril shield 60 that covers the nostril openings extending from the nose shield 50. The nose shield 50 has a top portion 51, a bottom portion 52, and a medial point 55 along the bottom portion 52 configured to cover and conform to the user's nose. The nostril shield 60 includes a pair of nostril holes 62 to facilitate breathing that extends from the medial point 55 of the bottom portion 52 of the nose shield 50 that is configured to cover the user's nostrils; wherein the nostril shield 60 is formed by a pair of extensions forming a single triangular piece having a first, second, and third sides; the first and second sides forming a triangular apex 61; the nostril shield 60 being connected to, and extending from, the medial point 55 of the bottom portion 52 of the nose shield 50 by the triangular apex 61; and wherein the first and second sides of the pair of extensions when folded come into contact with the bottom portion 52 of the nose shield 50 on two opposite respective sides of the medial point 55 of the bottom portion 52. Front and side views of the assembled low-coverage mask are shown in FIGS. 4A-B and 11A-B. As shown, the low-coverage mask covers the nose, cheek bones, and ears. FIG. 15 shows the low-coverage face mask worn on the user's face.

Figure 3:
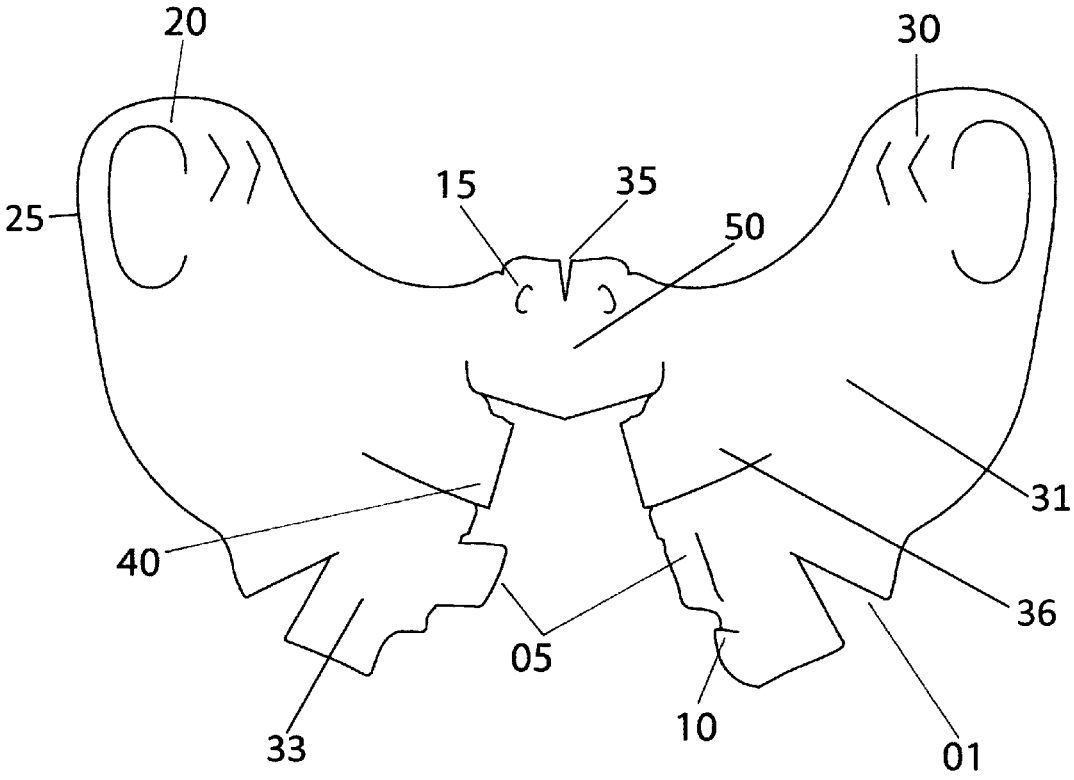
FIG. 3 shows a flat cut view of a full-coverage face mask in accordance with the present invention.
Figure 4:
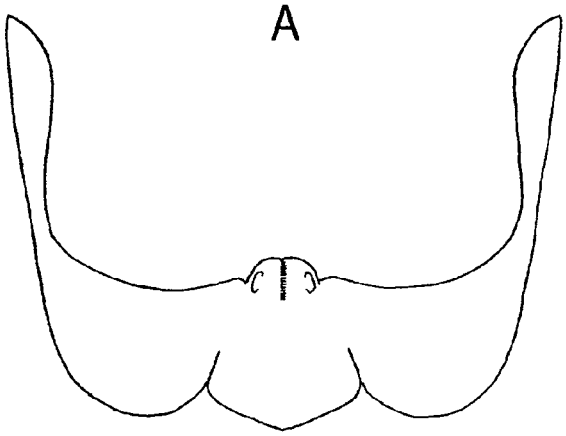
FIGS. 4A and 4B are front and side views, respectively, of a low-coverage face mask in accordance with the present invention.
Figure 4:
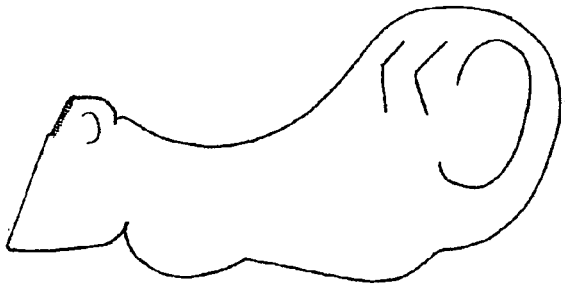
Figure 5:
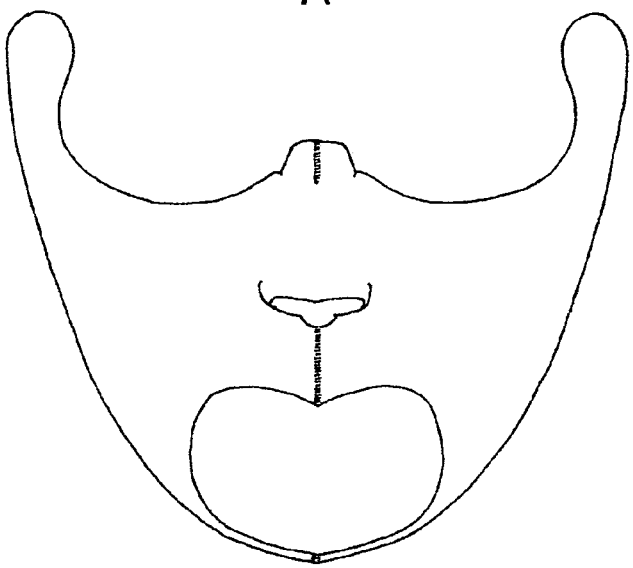
FIGS. 5A and 5B show front and side views, respectively, of a medium-coverage face mask in accordance with the present invention.
Figure 5:
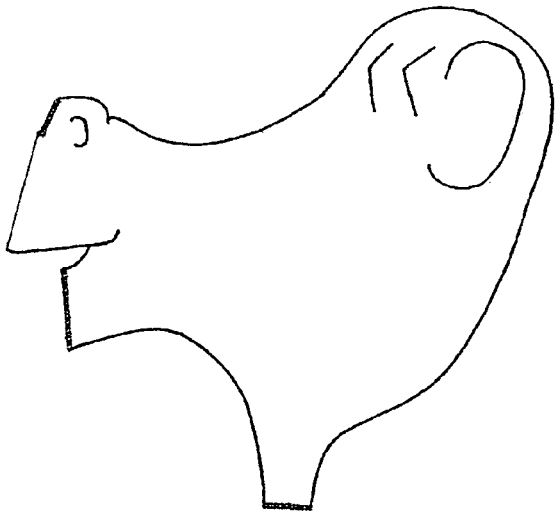
Figure 6:
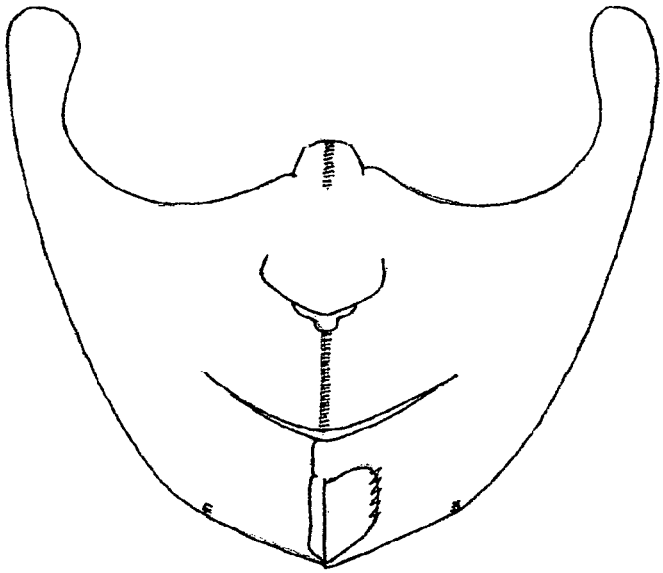
FIGS. 6A and 6B shows a front and bottom perspective view of a full-coverage face mask in accordance with the present invention.
Figure 6:
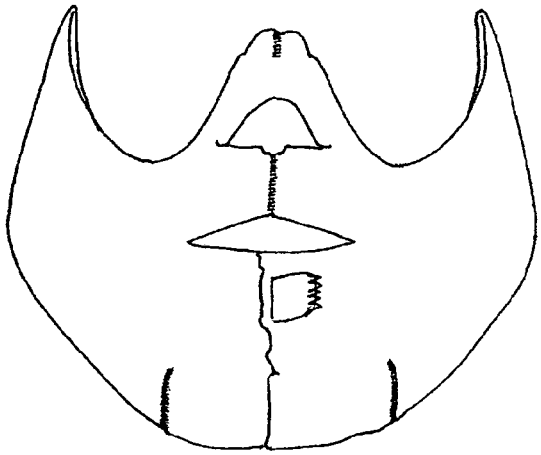

FIG. 3 shows an alternate embodiment of the present invention, a full-coverage face mask that offers more coverage than the medium-coverage mask of FIG. 1. The full face mask features the same seams and cuts as FIG. 1 except it also includes chin seam 01, chin interlock 05, and chin slit 10. In this unassembled, flat view, the face mask has a butterfly-like shape. Also, below the nose shield 50, the mid seam 40 is longer (e.g. 1/16" longer) than in the mid-coverage mask of FIG. 2. This provides great coverage of the user's mouth. The two and two side chin seams 01 to close scoop shape lines that cover and scoop the chin. The chin interlock 05 provides for connecting and closing the front chin portion 33 of the mask along with chin slit 10 to cover the chin and form a full facemask. Aside from the nose opening, the mid seam 40 creates a lip slit or mouth opening that serves as another air vent. As with the embodiments shown in FIGS. 1-2, the full face mask has curved insertion slits 30 and ear "C" cuts 20 which are configured to receive the user's ears. The face mask can be further secured to the user's eyewear via the "C" cuts 15 or with hook and loop patches, as set forth in the description of FIG. 1. Thus, all three of the face mask embodiments just described can be secured to the user's face and eyewear in the same way, providing the versatility of using the face masks with any type of eyewear, or no eyewear at all. Front and front-bottom views of the assembled full mask are shown in FIGS. 6A-B and 13A-B. As shown, full-coverage mask covers the nose, upper and lower lips, cheeks, ears, and chin.

FIGS. 8A and 8B shows front views of hook and loop (i.e. VELCRO®) patches for further securing the mask to the face by connecting the upper portion of the nose shield to the user's eyewear. The hook and loop patches have an adhesive underside for attachment to various surfaces. The hook patch can be placed on the upper portion of the nose shield 50 in between the "C" cuts as shown in FIG. 10B, while the loop patch is attached on the underside of the eyewear's nose bridge as shown in FIGS. 9A-B. When the mask and goggles are worn together as shown in FIG. 10A, the hook and loop patches mate and the nose shield is thereby attached to the user's goggles, further securing the mask to the face. Alternatively, if the underside of the goggle's nose bridge features a material comparable to a loop material (as is the case with certain goggles) then the loop patch may not be necessary and the hook patch can be affixed directly to the goggles.

While there have been described herein what are considered to be preferred and exemplary embodiments of the present invention, other modifications of the invention shall be apparent to those skilled in the art from the teachings herein. It is therefore desired to be secured, in the appended claims all such modifications as fall within the spirit and scope of the invention.

What is claimed is:

1. A flexible, low-coverage face mask for protecting a user's face from sunlight, wind, and other outdoor elements, comprising:

a face mask comprising a body formed of an outer first layer of spandex having a sun protective factor; an intermediate second layer of open-cell foam; and a third layer of micro-suede or brushed nylon material that is configured to contact the user's skin; the body further comprising:

a nose shield portion having a top portion, a bottom portion, and a medial point along the bottom portion configured to cover and conform to the user's nose; a pair of cheekbone shield portions configured to cover each of the user's cheekbones; a pair of ear strap portions containing a pair of "C"-shaped cuts and at least one pair of insertion slits; wherein the pair of "C"-shaped cuts are configured to cover and receive each of the user's ears and wherein the at least one pair of insertion slits are configured to receive eyewear of the user; each ear strap portion of the pair of ear strap portions contains one "C"-shaped cut of the pair of "C"-shaped cuts and one insertion slit of the at least one pair of insertion slits; and a nostril shield including a pair of nostril holes to facilitate breathing that extends from the medial point of the bottom portion of the nose shield that is configured to cover the user's nostrils; wherein the nostril shield is formed by a pair of extensions forming a single triangular piece having a first, second, and third sides; the first and second sides forming a triangular apex; the nostril shield being connected to, and extending from, the medial point of the bottom portion of the nose shield by the triangular apex; and wherein the first and second sides of the pair of extensions when folded come into contact with the bottom portion of the nose shield on two opposite respective sides of the medial point of the bottom portion.

2. The face mask of claim 1, wherein the top portion of the nose shield contains a pair of "C"-shaped cuts configured to receive nose pads of said user's eyewear to further secure the face mask to the user's face.

3. The face mask of claim 1, wherein a thin reinforcing strip is affixed to a skin-facing side of the nose shield, wherein the reinforcing strip allows the nose shield to better conform to the user's nose and retain its shape.

4. The face mask of claim 1, wherein a hook patch is affixed to an upper center portion of the nose shield, said hook patch configured to mate with a corresponding loop patch affixed under a nose bridge of said user's eyewear.

5. The face mask of claim 1, wherein the at least one pair of insertion slits are configured to keep said user's eyewear from moving out of place or falling off the user's face.

6. The face mask of claim 1, wherein the body is constructed by flame bonding the outer first layer, the intermediate second layer, and the third layer together followed by thermoforming.

7. The face mask of claim 1, wherein the body is defined by laser cutting the outer first layer, the intermediate second layer, and the third layer.

8. The face mask of claim 1, wherein the body comprises a plurality of perforations or holes configured to allow air to flow in and out of the face mask.

* * * * *